United States Patent [19]

Gadsby

[11] Patent Number: 4,584,094

[45] Date of Patent: Apr. 22, 1986

[54] METHOD AND APPARATUS FOR RECLAIMING COAL

[76] Inventor: William H. Gadsby, Treeneuk, Slack Lane, Ashgate, Chesterfield, Derbyshire, England

[21] Appl. No.: 617,984

[22] Filed: Jun. 6, 1984

[51] Int. Cl.[4] ..... B03B 7/00

[52] U.S. Cl. ..... 209/17; 209/172.5; 209/211

[58] Field of Search ..... 209/172.5, 17, 211, 209/3

[56] References Cited

U.S. PATENT DOCUMENTS

| | | | |
|---|---|---|---|
| 192,191 | 6/1877 | Richards | 209/13 X |
| 1,074,301 | 9/1913 | Trottier | 209/13 |
| 1,770,027 | 7/1930 | Dean | 209/156 X |
| 1,990,129 | 2/1935 | Menzies | 209/161 |
| 2,026,343 | 12/1935 | Vooys | 209/172.5 |
| 2,074,977 | 3/1937 | Bird et al. | 209/157 |
| 2,424,517 | 7/1947 | Stranahan | 209/17 |
| 2,571,835 | 9/1951 | Cleemann | 209/172.5 |
| 2,701,641 | 12/1955 | Krijgsman | 209/211 X |
| 2,778,496 | 1/1957 | Hirst | 209/13 |
| 2,781,906 | 2/1957 | Fontein | 209/172.5 |
| 2,932,395 | 4/1960 | Marot | 209/172.5 |
| 3,402,896 | 9/1968 | Daman | 209/13 |
| 3,746,265 | 7/1973 | Dancy | 209/172.5 |
| 3,794,162 | 2/1974 | Miller | 209/172.5 |
| 4,203,831 | 5/1980 | Parnaby | 209/13 |
| 4,219,409 | 8/1980 | Liller | 209/13 |
| 4,325,819 | 4/1982 | Altizier | 209/172.5 X |
| 4,364,822 | 12/1982 | Rich, Jr. | 209/211 X |

FOREIGN PATENT DOCUMENTS

| | | |
|---|---|---|
| 0161465 | 8/1953 | Australia . |
| 0726757 | 3/1955 | United Kingdom . |

*Primary Examiner*—Frank W. Lutter
*Assistant Examiner*—Thomas M. Lithgow
*Attorney, Agent, or Firm*—Jon C. Winger

[57] ABSTRACT

A method and system for reclaiming coal by separating useable coal from refuse includes a pre-conditioning stage wherein a raw feed stock of coal and refuse is mixed with a liquid medium, and a separation stage wherein the pre-conditioned feed stock is processed to separate useable coal from the refuse. In the pre-conditioning stage, the raw feed stock is used to prepare a slurried medium containing particulate material of a predetermined particulate size and of a pre-selected specific gravity. In the washing stage, the slurried medium is separated into two separated slurries, one being of lesser specific gravity than the slurried medium and the other being of greater specific gravity than the slurried medium. Usable coal is separated from the slurry of lesser specific gravity and refuse is separated from the slurry of greater specific gravity. The effluent from the slurries of lesser and greater specific gravities is collected for use in preparing the slurried medium in the pre-conditioning stage.

16 Claims, 3 Drawing Figures

METHOD AND APPARATUS FOR RECLAIMING COAL

BACKGROUND OF THE INVENTION

The present invention relates to classifying, separating and sorting solids utilizing an liquid suspension medium, and more particularly to a method and system for coal separation including a pre-conditioning stage wherein a separation slurry medium is prepared, and a feed stock of coal particles and refuse is sized; and a separation stage wherein the coal and refuse are separated from each other, and the effluent of the separating slurry medium is recovered for reuse in the preparation of more separating slurry medium.

DISCUSSION OF THE PRIOR ART

Various methods and apparatus are known in the art for cleaning and sizing coal. The following U.S. Patents are illustrative of these methods and systems.

U.S. Pat. No. 192,191 is directed to a device for separating and washing coal ore in order to concentrate and grade coal particles. Boxes contain stacked screens of diminishing mesh size. The coal is dumped into the boxes and as the coal passes downwardly, it is separated into different particle sizes by the screens. Chutes are located beneath each screen to transfer the separated or graded coal to tanks. The graded coal is transported by cart to washing bins. The washing bins are covered by screens. The coal from the cart is mixed with water and deposited on the screens of the bins. The particles passing through the screens is collected from the bins for use, and the material remaining on top of the screens is removed for disposal.

U.S. Pat. No. 1,074,301 is directed to an apparatus for separating coal ore according to specific gravity. The apparatus includes a vat filled with water. The floor of the vat is formed with a plurality of hoppers through. An oscillating box is located in the water filled vat. The floor of the box is formed of angled sections over each of the hoppers. Each section is of a screen or sieve construction. Coal ore is deposited in the box and as the box is oscillated, the ore forms beds of different specific gravities over the floor of the box. The separated coal ore passes through the screened sections into the various hoppers. The separated coal ore is then removed from the hoppers through valves for further processing or end use.

U.S. Pat. No. 1,770,027 is directed to an apparatus for separating materials of different specific gravities, particularly coal from rock, pyrites, slate and the like, which have a higher specific gravity than coal. The apparatus includes an inclined elongated tank filled with water. Two parallel inclined conveyors and are located within the tank. The upper end of the conveyors is above the water level in the tank. The lower end of the tank is provided with a sump having a drain for carrying off precipitate or residue. Coal ore to be separated is first passed through breaking rollers. The coal ore of reduced size passes from the breaking rollers into a chute which dumps the coal ore onto the conveyor near its lower end. Water currents are directed against the coal ore on conveyor from beneath by water spray nozzles. The water currents tend to lift the lighter material (coal ore) and carry it to the other conveyor while the heavier impurities such as rock and slate tend to remain on the first conveyor. The coal on conveyor is discharged onto chute at the upper end of the conveyor and the impurities are discharged onto another chute at the upper end of the conveyor.

U.S. Pat. No. 1,990,129 is directed to an apparatus for separating materials of different specific gravities particularly coal from rock, pyrites, slate and the like.

The pertinent portions of the apparatus includes a sorting tank connected to an upwardly inclined elongated water chamber through a tubular section. Coal mixture is delivered into the sorting tank through a chute along with water through a conduit. Water inlets are located through the walls of the sorting tank and are angled downwardly and angled to the horizontal to create a swirling effect in the sorting tank. An agitator is also located in the tank to cause further agitation within the tank. The elongated water chamber has its closed lower end below the tubular section, and its upper open end above the discharge rim of the sorting tank. In addition, a standpipe is connected to the elongated water chamber at a location below the overflow rim of the sorting tank. Water is fed into the elongated water chamber through a pipe at a location above the discharge rim of the sorting tank. A gate valve is located in the tubular section to open and close communication between the sorting tank and water chamber, and a valve is located in the water pipe to control the flow of water into the elongated chamber. A downward flow is created in the sorting tank by the conduit and water inlets, and an upward flow of water is created in the sorting tank through the tubular section from the elongated water chamber.

FIGS. 6–8 illustrate the operation of the apparatus with different densities of material in the sorting tank. Initially, the gate valve in the tubular section and water valve in the water pipe are set to provide a current upflow through tubular section at which salvageable coal first fails to appear in the refuse at the bottom of the sorting tank at the tubular section. FIG. 6 illustrates the condition of minimum density of material in the sorting tank therefore providing a maximum volume rate of water flow upwardly through the tubular section from the chamber into the bottom of the sorting tank. Under this condition, the sorting tank contains a small amount of refuse, and there is little resistance to the upward flow of water through the tubular section, and useable coal overflows the rim of the sorting tank. FIG. 7 shows a slight increase in the density of materials in the sorting tank resulting in an increase resistance to upflow through the tubular section. This causes the water level in the standpipe to rise thereby decreasing the volume rate of flow upwardly through the tubular section into the sorting tank which permits a slight increase in the discharge of refuse through the tubular section into the chamber. FIG. 8 shows a still further accumulation of refuse in the bottom of the sorting tank further increasing the upward flow of water through the section into the tank causing water to rise further in the standpipe thus decreasing the volume rate of flow of water into the tank through the section with the result of increasing the discharge of refuse from the sorting tank through the section into the chamber. As the refuse is discharged, the volume rate of flow increases upwardly through section into tank, thus, the apparatus is constantly self adjusting to varying material densities.

U.S. Pat. No. 2,026,343 is directed to separating materials of different specific gravity such as separating coal from heavier stone and other materials by means of a concentrated liquid of predetermined specific gravity.

A container is filled with a concentration liquid having a specific gravity slightly above the specific gravity of the coal to be separated. Coal and its mixed impurities are dumped into the top of the container through a chute. The useable coal floats on the surface of the liquid and the heavier refuse sinks. A skimmer combs of the coal from the liquid surface for further processing. The refuse is discharged from the bottom of the container.

U.S. Pat. No. 2,074,977 is directed to an apparatus for sorting coal from refuse. The apparatus includes a sloped elongated launder or trough. The trough includes a plurality of coal separation units along its length. Each coal separation unit is formed of compartments covered by screens. A slurry of coal and refuse is introduced at the elevated end of the trough to flow down the trough over the screens. Concurrently, the compartments are filled with water to a depth such that the water is above the top surface of the screens. The regulation of the velocity of the water flowing upwardly through the screens and the velocity of the coal slurry stream along the length of the trough determines to a large extent the specific gravity of the particles deposited in the pockets. The refuse material having a higher specific gravity than coal passes through the screens and into the compartments whereas the coal of lower specific gravity continued to flow in the stream along the trough over the screens.

U.S. Pat. No. 2,424,517 is directed to an apparatus for separating coal from refuse material having a higher specific gravity than coal. One use of the apparatus is the recovery of coal from slack dumps and the like. The apparatus includes an elongated tank divided by a transverse wall into a collection tank and a pressure tank. A dewatering screen is located over the top of the collection tank. A sloped deck is located over the pressure tank sloping downwardly toward the dewatering screen. A plurality of parallel flumes are located on the sloped deck. The bottoms of the flumes are open to the pressure tank. The pressure tank is filled with water under pressure to a level above the sloped deck. Material to be separated is deposited in the flumes. The heavier material falls through the open bottoms of the flumes into the tank while the lighter material flows over the top edges of the flumes and onto the sloped deck. The lighter materials flows along the deck to the dewatering screen, and the heavier material in the tank is removed from the tank by a drag conveyor.

U.S. Pat. No. 2,778,496 is directed to an apparatus for separating coal from its impurities. The apparatus of FIG. 1 includes a pulsatory action washer box which receives untreated coal. Separated fines a conveyed from the washer box to a dewatering shaker through conduit. Washed coal is removed from the dewatering shaker through conduit. The separated water is conveyed to a sump. the water and any suspended particles therein is conveyed from the sump to a settling tank. The settling tank includes a water overflow returning water from the settling tank back to the sump. Slurry from the settling tank is conveyed to another dewatering shaker for the removal of the smaller fine particles from the slurry. The water separated in the dewatering shaker is conveyed back to the first washer box. In the apparatus of FIG. 2, the slurry from the settling tank passes through a trough washer located upstream of the second dewatering shaker. The trough washer separates refuse from the slurry. The refuse separated from the slurry by the trough washer is conveyed to the first dewatering shaker for additional dewatering and the slurry is conveyed to the second dewatering shaker for recovery of the fines.

U.S. Pat. No. 3,402,896 is directed to a portable ore milling and concentrating plant particularly useful for reclaiming ore from ore dumps. The plant includes a water tank for supplying water to a trommel screen device, a classifier device, a jig device, and a flotation machine. Dump ore is fed into the trommel screen which functions as a grinding mill. The trommel screen has a perforated periphery through which desired particle sizes of material pass from the screeen to a chute for further processing through the plant while reject material is discharged from the downstream end of the screen through chute for disposal. The reusable material passes from the chute to the classifier. The classifier separates coarse material which cannot be concentrated by froth flotation from the less coarse material. The coarser material is deposited in the jig device which separates gangue and hutch from the coarser material. The less coarse material (in the flotation size range) is discharged from the classifier into the flotation machine. Froth concentrate is discharged as a final product from the flotation machine and the remaining middlings are pumped from the flotation machine back to the screen for further size reduction processing through the plant.

U.S. Pat. No. 4,203,831 is directed to a coal washing machine to separate combustible coal from non-combustible material. The machine includes a tumbling barrel and cyclone separators. Run of mill coal ore is fed into the upper end of the inclined barrel and flooded with wash water. Shale works upwardly in the barrel and is discharged at the upper end thereof and coal is discharged from the lower end of the barrel into a sifting and dewatering screen. The screen also grades the coal into coarse and less coarse particles, and deposits the finer particles into collecting tank and the coarser particles into collecting tank. The slurry of coarser particles is recirculated back to the upper end of the tumbler barrel for reprocessing, and the slurry of finer particles is conveyed to the cyclone separators. The cyclone separators separate coal from dross based upon the specific gravities thereof. The dross is discarded, and the coal is conveyed to a dewatering device. The removed water is circulated for use in the tumbler barrel.

U.S. Pat. No. 4,219,409 discloses in FIG. 7, a coal washer plant which employs cyclone separators. Raw coal is fed to a first slurry tank along with make up water to form a slurry having a known percent of solids. The make-up water contains a caustic to minimize corrosive action. The slurry is conveyed to the cyclone separators under a pressure of from 10 psi to 25 psi. The cyclones classify the slurry by specific gravity into two slurries: a light clean coal slurry and a heavy refuse slurry. The clean coal slurry is conveyed to sieve screens where water and some clean coal fines are separated from larger clean coal particles. The larger clean coal fraction is delivered to a dryer and dried to less than percent moisture and deposited in a clean coal pile. Water and clean coal fines from coal dryer are delivered to a fine coal slurry tank along with the fine coal slurry from the screens. The fine coal slurry from tank is delivered to clarifying cyclones which split the slurry into two fractions: clarified water and high solids content clean coal slurry. The clarified water is pumped back to the first slurry tank, and the clean coal slurry is delivered to dryer whereat it is dired to from to percent moisture. The clean dry coal is conveyed from the dryer to the clean coal pile. The heavy refuse slurry from the cyclones is delivered to dewatering screen whereat it is spit into two fractions: a dewatered coarse refuse and a fine refuse and water (silt water). The coarse refuse is placed in a refuse pile for disposal, and the silt water is delivered back to a silt pond.

U.S. Pat. No. 4,325,819 is directed to a method and apparatus for processing a slurry of coal to recover coal fines. The apparatus includes (FIG. 1) a barrel washer into which coal ore to be processed is deposited along with water from pipe and a media liquid from pipe. The media liquid is a combination of water and coal fines having a controlled specific gravity. The angle and rotational speed of the barrel are controlled to provide maximum separating efficiency. The reject material being heavier than the coal sinks to the bottom of the barrel and is discharged from the upper end of the barrel into collecting conduit as a first effluent. A screen attached to the lower end of the barrel passes material of greater than ½ inch onto a rinse screen, and a water spray rinses the coal on the rinse screen. Washed coal larger than ½ inch is deposited on the conveyor ready for use. Water and coal of less than ½ inch pass through the rinse screen as a first slurry and is collected in sump tank. Concurrently, coal and debris pass through screen at the end of barrel into conduit and is conveyed to a compartment of a two compartment sump tank. The heavier particles settle to the bottom of the compartment are transferred to a cyclone while the lighter particles over flow the partition from compartment and into compartment. The cyclone separates the heavier debris from the coal fines. The debris is discharged through conduit to a holding tank and the coal fines are discharged to screen. Particles larger than the screen are collected by conduit and the liquid and particles passing through the screen are conveyed back to the barrel through pipe. The debris and water is conveyed from the holding tank to a cyclone for further recovery of coal fines which may be remaining in the debris from cyclone. The rejected debris from cyclone is discharged for disposal, and the separated fines are conveyed to a screen. The coal smaller than the screen passes through the screen and is carried back to the holding tank to maintain the specific gravity in the solution conveyed to the cyclone. The larger particles which do not pass through the screen are carried to a distribution head and is distributed over a screen. The coal which is larger than the screen is washed with water from spray heads and the water and smaller particles pass through the screen into the compartments. The coal on the screen is removed on conveyor for end use or alternatively the coal can be transferred to a centrifugal dryer. The removed liquid is transferred from the dryer back to the settling tank and the dried coal transferred on conveyor for end use. The slurry from the settling tank is pumped to a cyclone separator which separates debris from remaining coal fines. The coal fines from cyclone separator are deposited on a screen. The liquid and fines smaller than the screen pass through and is transferred to a separator. The coal fines separated by the separator are deposited on the conveyor and the debris is transported to a water clarifier. The coal fines larger than screen are transported to dryer and hense to the conveyor. With reference to FIG. 4, the first effluent from the barrel moving in pipe is transferred to screen, and the liquid and debris from cyclone is transported to a collecting tank. The effluent is removed from tank to a separator. The solids from separator are deposited on screen with the first effluent from the barrel. The liquid and solids smaller than screen pass therethrough into hopper and are transferred to a collecting tank. The solids too large to pass through the screen are removed for disposal on conveyor. The water from separator is collected in a water clarifier. The sludge is transported from the water clarifier to the collecting tank and the clarified water is transported from the clarifier to a holding tank. The collected sludge in collecting tank is transferred to a centrifugal separator which rejects the solid material onto conveyor for disposal and the effluent is transported back to the clarifier for further treatment. The clarified water in holding tank is used as the water wash supplied through washers.

SUMMARY OF THE INVENTION

An object of the present invention is to provide a method and system for separating usable coal from refuse using a separating slurry medium.

A further object of the present invention is to provide a method and system for separating coal and refuse wherein the separating slurry medium is recirculated through the system for reuse therein.

Another object of the present invention is to provide a method and system for sizing the coal to be recovered.

Yet another object of the present invention is to provide a system of the class described which can be readily moved from one mine site to another.

More particularly, the present invention, in one embodiment, provides a method for separating coal from refuse comprising mixing raw feed stock consisting of coal and refuse material with a liquid medium to form a first slurry, separating the particulate material of over a first predetermined size from the first slurry thereby creating a resulting second slurry, separating particulate material of less than the first predetermined particulate size and larger than a second predetermined size from the second slurry creating a first effluent, using a portion of the first effluent as the liquid medium mixed with the raw feed stock, mixing a selected portion of the first effluent with the particulate material previously separated from the second slurry to form a third slurry of pre-selected specific gravity, separating the third slurry into a fourth slurry containing coal particles and refuse material of a lesser specific gravity than the third slurry and a fifth slurry containing refuse material of a greater specific gravity than the third slurry, separating the coal particles from the fourth slurry, collecting the effluent of the fourth slurry resulting from separation of the coal particles from the fourth slurry, separating the refuse material from the fifth slurry, collecting the effluent of the fifth slurry resulting from separation of the refuse material from the fifth slurry, and using the effluents collected from the fourth and fifth slurries to supplement the first effluent separated from the first slurry.

In another embodiment, the present invention provides a system for separating coal from refuse comprising: first scrubber means for creating a first slurry consisting of a feed stock of coal and refuse material and a liquid medium; first separation means for separating particulate material of over a predetermined first size from the first slurry, thereby creating a second slurry; second separation means for separating particulate material of less than the first predetermined particulate size and larger than a second predetermined size from the second slurry thereby creating a first effluent; means for conveying a portion of the first effluent back to the first scrubber means; means for mixing a selected portion of the first effluent with the particulate material separated from the second slurry by the second separation means thereby creating a third slurry of pre-selected specific gravity; third separation means for separating the third slurry into a fourth slurry of lesser specific gravity than the third slurry, and a fifth slurry of a greater specific gravity than the third slurry; means for separating coal particulates from the fourth slurry; means for collecting the effluent of the fourth slurry resulting from separation of the coal particles from the fourth slurry; means for separating refuse material from the fifth slurry; means for collecting the effluent of the fifth slurry resulting from separation of the refuse material from the fifth slurry; and means for mixing the effluents collected from the fourth and fifth slurries with the first effluent.

BRIEF DESCRIPTION OF THE DRAWINGS

The present invention will become more clear upon reference to the following detailed description and in conjunction with the accompanying drawings in which like numerals refer to like components and wherein.

DESCRIPTION OF THE PREFERRED EMBODIMENTS

Figure 1:
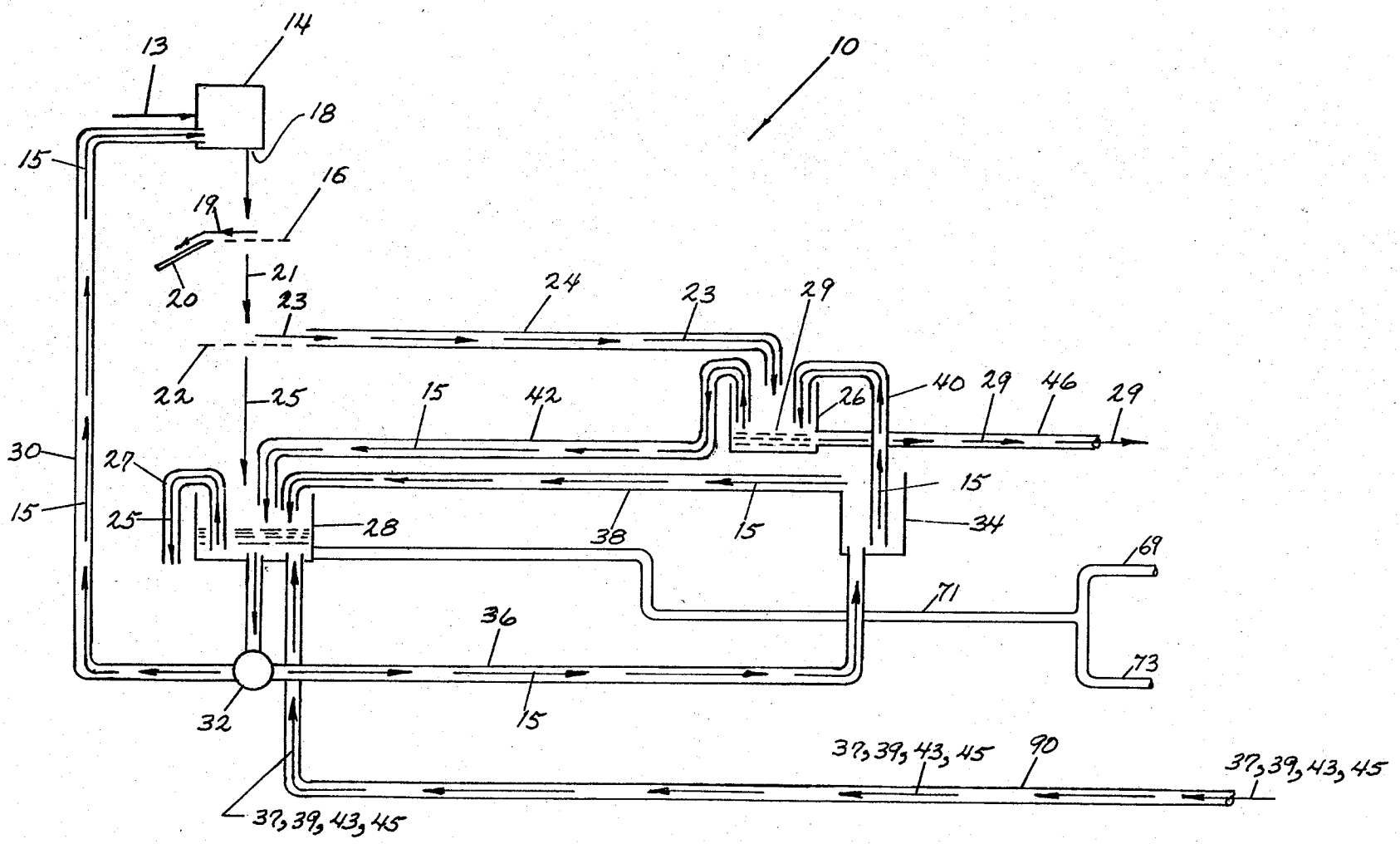
FIG. 1 is a schematic representation of a pre-conditioning stage of the method and system of the present invention.

The method and system of the present invention includes two stages, a pre-conditioning stage (see FIG. 1) generally denoted as the numeral 10, and a separation stage (see FIG. 2) generally denoted as the numeral 12. In general, the pre-conditioning stage 10 is utilized to prepare a separating liquid medium 15 using selected portions of the coal containing raw feed stock, and the feed stock is sized to a predetermined particle size for feed to the separation stage 12, and the separation stage 12 is utilized to separate usable coal and refuse from the feed stock received from the pre-conditioning stage 10, drain the separated coal, and recover the effluent separated from the coal for reuse in preparing more separating liquid medium 15.

With reference to FIG. 1, the pre-conditioning stage 10 includes a scrubber 14 having a first screen 16 of a first predetermined mesh size disposed over the scrubber outlet 18. For example, the screen 16 would have openings of 37.5 MM. Coal containing raw feed stock from, for example, a slag pile or run of mine coal, is delivered to the first scrubber 14 along with liquid medium. The first scrubber breaks-up and mixes the raw feed stock with the liquid medium to produce a first slurry 17. As the first slurry leaves the first scrubber 14, it passes through the first screen 16 separating particulate material of a size greater than the mesh size of the first screen 16 from the first slurry. The particulate material 19 separated out by the first screen 16 is removed from the first screen 16 by, for example, a chute 20 for disposal. A sieve 22 is located in flow communication with the first screen 16 to receive the second slurry 21 passing through the first screen 16 resulting from the separation of particulate material 19 from the first slurry. The sieve 22 is sized to separate particulate material 23 from the second slurry 21 smaller in size than the particulate material 19 separated from the first slurry 17 by the first screen 16. The particulate material 23 separated out of the second slurry 21 by the sieve 22 is passed through, for example, a conduit 24 to a first washing cyclone feed tank 26. A circulating medium tank 28 is located in flow communication with the sieve 22 to receive the first effluent 25 passing through the sieve 22 resulting from the separation of particulate material 23 from the second slurry 21. The circulating medium tank 28 is in flow communication with the first scrubber 14 for delivering liquid medium 15 to the first scrubber 14 to be mixed with the raw feed stock to form the first slurry 17 in the first scrubber 14. The flow communication can be accomplished with, for example, a conduit 30 having a pump 32 for moving the liquid medium through the conduit 30. A splitter box 34 is in supply liquid flow communication with the circulating medium tank 28 for receiving a quantity of liquid medium 15 from the circulating medium feed tank 28 by means of, for example, a conduit 36, and in return liquid flow communication back to the circulating medium tank 28 for returning excess amounts of liquid medium 15 back to the circulating medium tank 28 by means of a conduit 38. the splitter box 34 is also in liquid flow communication with the first washing cyclone feed tank 26 for supplying a desired quantity to the cyclone feed tank 26 by means of a conduit 40. The splitter box 34 distributes liquid medium 15 to the cyclone feed tank 26 to enable control of the solids/liquid medium ratio of the third slurry 29 formed in the washing cyclone feed tank 26. The third slurry 29 is a mixture of the particulate material separated from the second slurry 21 by the sieve 22 and the controlled quantity of liquid medium 15 from the splitter box 34. The quantity of liquid medium 15 not circulated to the cyclone feed tank 26 is returned to the circulating medium tank 28. The first washing cyclone feed tank 26 is in return liquid medium flow communication with the circulating medium tank 28 by means of, for example, a conduit 42 for returning excess liquid medium 15 back to the circulating medium tank 28.

Figure 2:
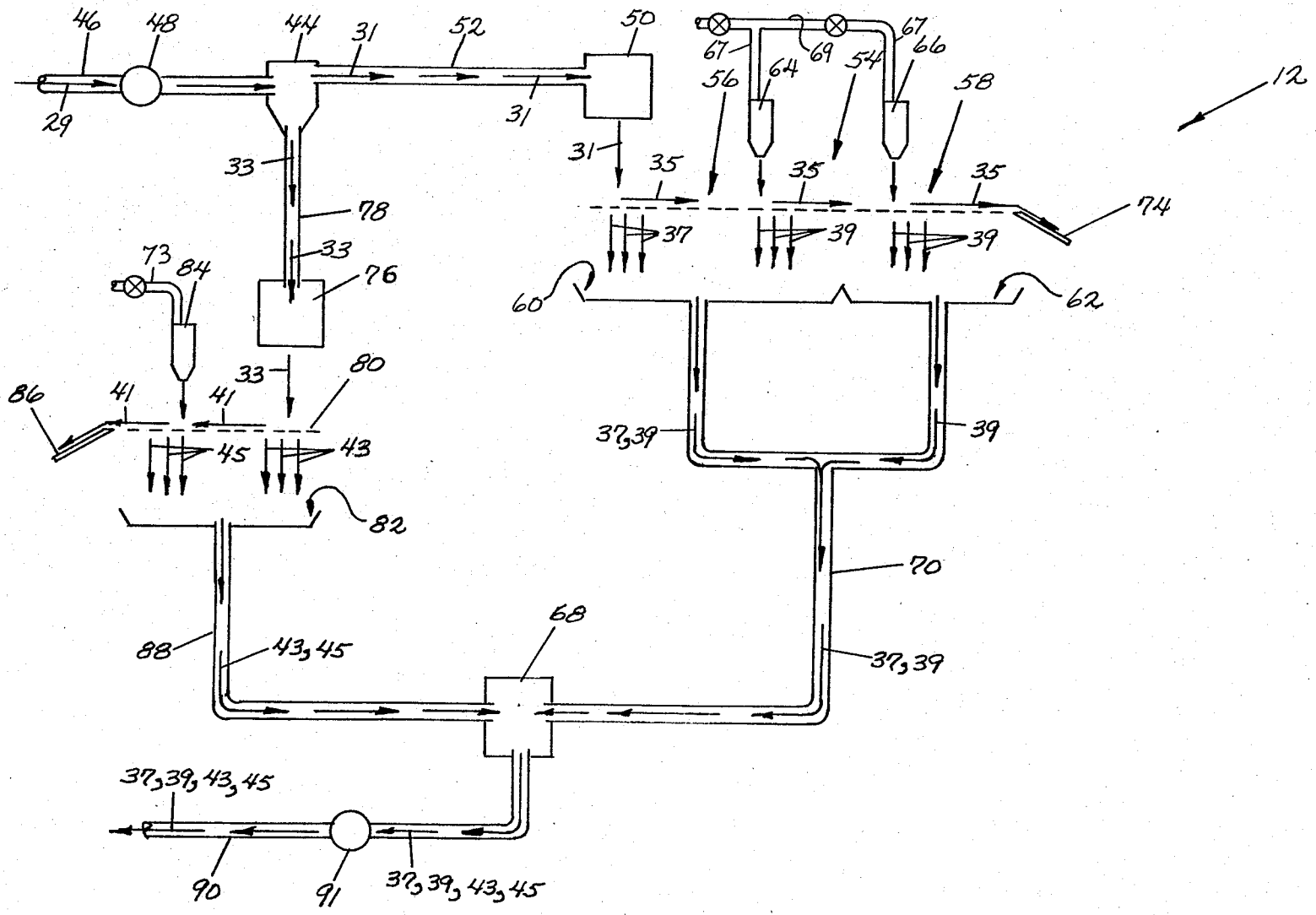
FIG. 2 is a schematic representation of a separation stage of the method and system of the present invention; and, FIG. 3 is a schematic representation of an additional, optional, feature of the present invention incorporated in the separation stage of FIG. 2.

Now with reference to FIG. 2, the separation stage 12 is shown as including a first washing cyclone 44 in liquid flow communication with the first washing cyclone feed tank 26 for receiving the third slurry 29 from the feed tank 26. This liquid flow communication can be established by, for example, a conduit 46 having a pump 48 therein for moving the third slurry 29 from the washing cyclone feed tank 26 to the first washing cyclone 44. A fourth slurry 31 comprising clean coal, which has a specific gravity or density less than the refuse material of the third slurry 29 overflows the first washing cyclone 44 and is conveyed to a first collecting box 50 through, for example, a conduit 52. A drain-rinse screen 54 is located in liquid flow communication with the first collecting box 50. As shown, the drain-rinse screen 54 is disposed beneath the outlet of the first collection box 50 to receive the fourth slurry 31. The drain-rinse screen 54 has a mesh size somewhat smaller than the mesh size of the sieve 22 of the pre-conditioning stage 10, and comprises a drain section 56 and a rinse section 58. The drain section 56 of the drain-rinse screen 54 first receives the fourth slurry 31 from the first collection box 50. As the fourth slurry 31 of clean coal moves over the drain rinse screen 54 from the drain section 56 to the rinse section 58, effluent fraction of the fourth slurry 31 drains through the drain section 56 as a second effluent 37 into a first effluent drain pan 60 located beneath the drain section 56, and through the rinse section 58 into a second effluent drain pan 62 located beneath the drain section 58. A first spray device 64 is located over the drain section 56 oriented to selectively direct a spray of liquid medium 15 over fourth slurry 31 moving over the drain section 56 toward the rinse section 58 for selectively diluting the second effluent fraction 37 of the fourth slurry 31 as it drains from the clean coal fraction by reducing the concentration of particulate material which may be included in the second effluent 31. In addition, a second spray device 66 is located over the rinse section 58 oriented to direct a spray of liquid medium 15 over the drained clean coal to rinse any remaining refuse material, which may be adhering to the otherwise clean drained coal which drains through the rinse section 58 as a third effluent 39. The mixture of second and third effluents in the drain pans 60 and 62 is conveyed to an effluent collecting tank 68 which is in effluent flow communication with the drain pans 60 and 62 by means of, for example, a conduit 70. The clean, drained, rinsed coal leaves the drain-rinse screen 54 by means of, for example, a chute device 74 for collection. The spray devices 64 and 66 are in liquid medium communication with the circulating medium tank 28 through a branch conduits 67 connecting to a feed conduit 69 which ties into a flow conduit 71 from the medium tank 28. Valves are located in the branch conduits 67 to selectively control liquid medium to each of the spray devices 64 and 66.

The underflow of refuse material which has a higher specific gravity than the third slurry 29 leaves the bottom region of the first washing cyclone 44 as a fifth slurry 33, and is conveyed to a second collection box 72 through, for example, a conduit 78. A refuse drain screen 80 is located in liquid flow communication with the second collection box 72. As shown, the refuse drain screen 80 is disposed beneath the outlet of the second collection box 72 to receive the fifth slurry 33. The refuse drain screen 80 has a mesh size corresponding to the mesh size of the drain-rinse screen 54. As the fifth slurry 33 of refuse and liquid medium moves over the refuse drain screen 80, effluent fraction of the fifth slurry 33 drains through the refuse drain screen 80 as a fourth effluent 43 into a third effluent drain pan 82 located beneath the refuse drain screen 80. A third spray device 84 is located over the refuse drain screen 80 oriented to direct a spray of liquid medium over the drained refuse fraction 41 of the fifth slurry 33 to rinse adhering material smaller than the mesh size of the refuse screen 80 from the larger particles of refuse which drains through the screen 80 as a fifth effluent 45 into the pan 82. The clean, drained rinsed refuse 41 leaves the refuse drain screen 80 by means of, for example, a chute 86 for collection and disposal. The mixture of fourth effluent fraction 43 of the fifth slurry 33 and fifth effluent 45 in the third effluent drain pan 82 is conveyed to the effluent collecting tank 68 which is in effluent flow communication with the drain pan 82 by means of, for example, a conduit 88. The spray device 84 is in liquid medium communication with the circulating medium tank 28 through a feed conduit 73 connecting to the flow conduit 71 from the medium tank 28. A valve is located in the feed conduit 73 to selectively control liquid medium flow to the spray device 84.

The collected effluent mixture of second, third, fourth and fifth effluents 37, 39, 43 and 45 in the effluent collecting tank 68 is conveyed back to the circulating medium tank 28 of the pre-conditioning stage 10 for reuse in formulating the liquid medium 15 supplied to the first scrubber 14 and for use in adjusting the specific gravity of the third slurry in the washing cyclone feed tank 26. This can be accomplished by means of, for example, a conduit 90 having a pump 91.

Figure 3:
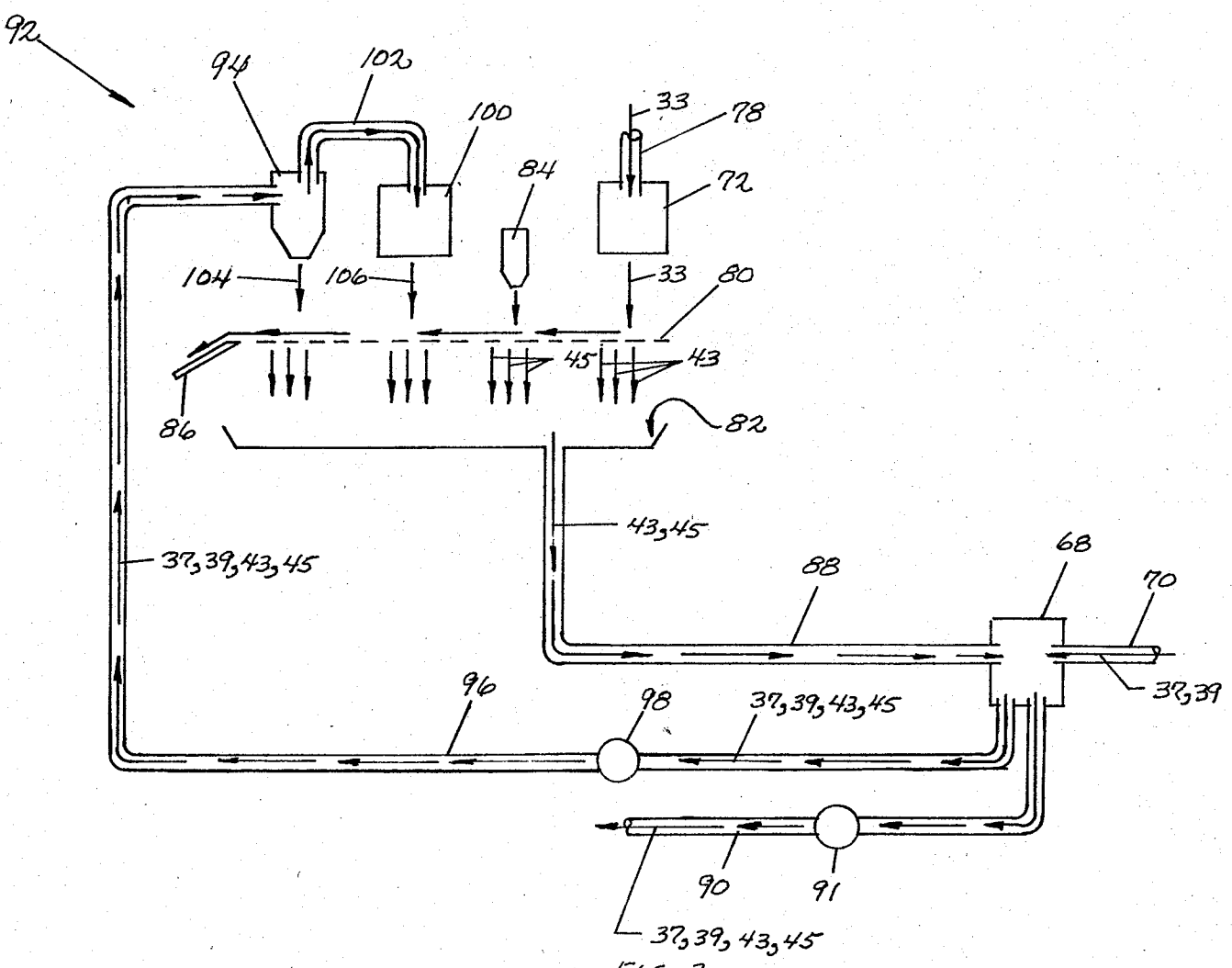

Now with reference to FIG. 3, there is shown an optional feature of the present invention which can be used in addition to the spray device 84 to further selectively adjust the specific gravity of the liquid separating medium reclaimed in the separation stage 12. This optional separating medium specific gravity adjusting system is generally denoted as numeral 92 is used without deleting any of the features of the separation stage 12, and is shown as including a separating cyclone device 94 in effluent flow communication with the effluent collecting tank 68 for receiving the mixture of second, third, fourth and fifth effluents from the effluent collecting tank 68. This flow communication can be established by means of, for example, a conduit 96 interconnecting the collecting tank 68 and cyclone device 94 having an effluent pump 98. The cyclone device 94 is located with its underflow outlet in flow communication with the refuse drain screen 80. An overflow collection tank 100 is also located with its outlet in flow communication with the refuse screen 80. The overflow collection tank 100 is in overflow communication with the cyclone device 94 by means of, for example, a conduit 102 to receive the overflow fraction separated from the effluent by the separating cyclone device 94. The mixture of effluents from the effluent collecting tank 68 is selectively conveyed to the separating cyclone device 94 wherein it is separated into a lighter effluent fraction 106 which overflows into the overflow collection tank 100, and a heavier effluent fraction 104 which remains in the cyclone device 94. When it is desired to increase the specific gravity of the mixture of effluents contained in the effluent collecting tank 68 to be reused in the pre-conditioning stage 10, the heavier effluent fraction 104 is discharged from the cyclone device 94 to the refuse drain screen 80 to mix with the mixture of fourth and fifth effluents 43 and 45 in the third effluent drain pan 82. Similarly, when it is desired to decrease the specific gravity of the mixture of effluents contained in the effluent collecting tank 68 to be reused in the preconditioning stage 10, the lighter effluent fraction 106 is discharged from the cyclone device 94 to the refuse screen 80 to mix with the mixture of fourth and fifth effluents 43 and 45 in the third effluent drain pan 82.

In operation, a raw feed stock of coal and refuse material 13, which can be discarded from, for example, a slag pile or run-of-mine material, and the liquid separating medium 15 are fed to the first scrubber device 14 wherein the raw feed stock 13 and separating medium 15 are throughly mixed together to form the first slurry 17. Particulate material 19 larger than a first predetermined size, for example 37.5 mm, is separated from the first slurry 17 as it passes through the first screen 16. The separated particulate material 19 is discharged from the system for disposal. After the resulting second slurry 21 passes through the first screen 16, particulate material 23 smaller than the first predetermined size, but larger than a second predetermined size is separated from the second slurry 21 as it passes through sieve 22. The separated particulate material 23 of the second predetermined size is moved through conduit 24 to the washing cyclone feed tank 26, and the resulting first effluent 25 is passed from the sieve 22 to the circulating medium tank 28. Any excess first effluent 25 in the circulating medium tank 28 will pass as overflow 27 to an effluent disposal system (not shown). A portion of the mixture of first second, third, fourth and fifth effluents is returned to the first scrubber device 14 as the liquid separating medium 15 to be mixed with the raw feed stock 13 to form the first slurry 17 through conduit 30. Another portion of the liquid separating medium 15 is conveyed to the splitter box 34 through the conduit 36. A selected portion of the liquid separating medium 15 is conveyed from the splitter box 34 to the first washing cyclone feed tank 26 through the conduit 40 wherein it is thoroughly mixed with the particulate material 23 to form a third slurry 29 of a selected specific gravity. The portion of the liquid separating medium 15 not metered to the first cyclone feed tank 26 is returned to the circulating medium tank 28 through conduit 38 for recycling. Any excess liquid separating medium 15 in the first washing cyclone feed tank 26 will overflow into conduit 42 for return to the circulating medium tank 28 for recycling. The pre-conditioned third slurry 29 of selected specific gravity is transferred from the cyclone feed tank 26 of the pre-conditioning stage 10 to the first washing cyclone device 44 through the conduit 46 by the pump 48. The first cyclone device 44 separates the third slurry 29 into a fourth slurry 31 having coal particles and refuse material of lesser specific gravity than that of the third slurry 29, and a fifth slurry 33 having refuse material of greater specific gravity than that the third slurry 29. The overflow of fourth slurry 31 comprised of clean coal particles and light refuse material is transferred from the first cyclone device 44 through the conduit 52 to the first collection box 50, and the underflow fifth slurry 33 is transferred from the first cyclone device 44 to the second collection box 72 through conduit 78. Particulate material 35, which is smaller than the second predetermined size separated from the second slurry 21 but larger than a third predetermined size, is separated from the fourth slurry 31 as the fourth slurry 31 passes from the first collection box 50 through the drain-rinse screen 54. The particulate material 35 of the third predetermined size is primarily coal which may have some residual refuse material adhering to it. The resulting second effluent 37 passing through the drain section 56 of drain-rinse screen 54, comprising particulate material smaller than the third predetermined size, is collected in the first effluent drain pan 60. The recovered particulate coal material 35 is rinsed of any adhering refuse material as it passes over the drain-rinse screen 54 from the drain section 56 to the rinse section 58 and beneath the first and second spray devices 64 and 66. The liquid medium issuing from the spray devices 64 and 66 along with any residual refuse material smaller than the particulate coal 35 rinsed from the particulate coal material 35 passes through the drain-rinse screen 54 as a third effluent 39 and is collected in the second effluent drain pan 62. The spray devices 64 and 66 can be selectively operated to discharge liquid medium as may be required from time to time to dilute the concentration of particulate material in the second and third effluents 37 and 39 collected in the drain pans 60 and 62. The cleaned, sized and drained coal particulate material 35 is conveyed by chute 74 from the drain-rinse screen 54 for collection, and the mixture of second and third effluents 37 and 39 collected in the drain pans 60 and 62 is transferred to the effluent collection tank 68 through conduit 70. Particulate material 41 of fourth predetermined size, which is smaller than the second predetermined size separated from the second slurry but larger than the third predetermined size, is separated from the fifth slurry 33 as the fifth slurry 33 passes from the second collection box 76 through the refuse drain screen 80. The particulate material 41 of the fourth predetermined size is primarily refuse material. The resulting fourth effluent 43 passing through the refuse drain screen 80, comprising refuse material smaller than the fourth predetermined size, is collected in the third effluent drain pan 82. The recovered particulate refuse material 41 is rinsed of any adhering refuse material as it passes over the drain screen 80 beneath the third spray device 84. The liquid medium issuing from the third spray device 84 along with any residual refuse material smaller than the particulate refuse material 41 rinsed from the refuse material 41 passes through the refuse drain screen 80 as a fifth effluent 45 and is collected in the third effluent drain pan 82. The cleaned, sized and drained refuse particulate material 41 is conveyed by chute 86 from the refuse drain screen 80 for collection and disposal, and the mixture of fourth and fifth effluents 43 and 45 collected in the third drain pan 82 is transferred to the effluent collection tank 68 through conduit 88. The mixture of second, third, fourth and fifth effluents in the effluent collection tank 68 is transferred to the circulating medium tank 28 through the conduit 90 by the pump 91 for use in formulating the liquid separating medium 15 and first effluent.

The foregoing detailed description is given primarily for clearness of understanding and no unnecessary limitations should be understood therefrom for modifications will become obvious to those skilled in the art upon reading this disclosure and may be made without departing from the spirit of the invention and scope of the appended claims.

What is claimed is:

1. A method for separating coal from refuse comprising:

Mixing a raw feed stock consisting of coal and refuse material with a liquid medium to form a first slurry;

separating particulate material of over a first predetermined size from the first slurry thereby creating a resulting second slurry;

separating particulate material of less than the first predetermined particulate size and larger than a second predetermined size from the second slurry creating a first effluent;

mixing a selected portion of the liquid medium with the particulate material previously separated from the second slurry to form a third slurry of preselected specific gravity;

separating the third slurry into a fourth slurry containing coal particles and refuse material of a lesser specific gravity than the third slurry, and a fifth slurry containing refuse material of a greater specific gravity than the third slurry;

separating the coal particulates from the fourth slurry;

collecting the effluent of the fourth slurry resulting from separation of the coal particles from the fourth slurry as a second effluent;

separating the refuse material from the fifth slurry;

collecting the effluent of the fifth slurry resulting from separation of the refuse material from the fifth slurry as a fourth effluent; and using the second and fourth effluents collected from the fourth and fifth slurries and the first effluent separated from the second slurry as the liquid medium.

2. The method of claim 1 further comprising:

rinsing the coal particulates separated from the fourth slurry with liquid medium; and, collecting the effluent consisting of liquid medium used to rinse the coal particulates and material rinsed from the coal particulates as a third effluent.

3. The method of claim 2, further comprising adding the collected third effluent to the second effluent.

4. The method of claim 3, further comprising using a predetermined amount of liquid medium to rinse the coal particulates separated from the fourth slurry to result in a mix of collected second and third effluents from the fourth slurry of a pre-selected specific gravity.

5. The method of claim 4, further comprising using the mix of collected second and third effluents from the fourth slurry as a component of the liquid medium.

6. The method of claim 2, further comprising:

rinsing the refuse material separated from the fifth slurry with liquid medium; and, collecting the effluent consisting of liquid medium used to rinse the refuse and material rinsed from the refuse material as a fifth effluent.

7. The method of claim 6, further comprising adding the collected fifth effluent to the fourth effluent.

8. The method of claim 7, further comprising using a predetermined amount of liquid medium to rinse the refuse material separated from the fifth slurry to result in a mix of collected fourth and fifth effluents from the fifth slurry of a pre-selected specific gravity.

9. The method of claim 8, further comprising using the mix of collected fourth and fifth effluents from the fifth slurry as a component of the liquid medium.

10. The method of claim 1, further comprising:

rinsing the coal particulates separated from the fourth slurry with liquid medium;

collecting the effluent consisting of liquid medium used to rinse the coal particulates and material rinsed from the coal particulates as a third effluent;

rinsing the refuse material separated from the fifth slurry with liquid medium;

collecting the effluent consisting of liquid medium used to rinse the refuse and material rinsed from the refuse material as a fifth effluent;

mixing a portion of the collected fifth effluent to the fourth effluent;

adding portions of the second, third, fourth and fifth effluents together;

separating a portion of the mix of second, third, fourth and fifth effluents into an effluent fraction having a lesser specific gravity than the mix of second, third, fourth and fifth effluents, and an effluent fraction having a greater specific gravity than the mix of second, third, fourth and fifth effluents;

selectively mixing the effluent fraction of lesser specific gravity with the mix of fourth and fifth effluents to decrease the specific gravity thereof to a predetermined value; and, selectively mixing the effluent fraction of greater specific gravity with the mix of fourth and fifth effluents to increase the specific gravity thereof to a predetremined value.

11. A system for separating coal from refuse comprising:

first scrubber means for creating a first slurry consisting of a feed stock of coal and refuse material and a liquid medium;

first separation means for separating particulate material of over a predetermined first size from the first slurry, thereby creating a second slurry;

second separation means for separating particulate material of less than the first predetermined particulate size and larger than a second predetermined size from the second slurry thereby creating a first effluent;

means for mixing a selected portion of the liquid medium with the particulate material separated from the second slurry by the second separation means thereby creating a third slurry of preselected specific gravity;

third separation means for separating the third slurry into a fourth slurry of lesser specific gravity than the third slurry, and a fifth slurry of greater specific gravity than the third slurry;

means for separating coal particulates from the fourth slurry;

means for collecting the effluent of the fourth slurry resulting from separation of the coal particles from the fourth slurry as a second effluent;

means for separating refuse material from the fifth slurry;

means for collecting the effluent of the fifth slurry resulting from separation of the refuse material from the fifth slurry as a fourth effluent; and means for mixing the second and fourth effluents collected from the fourth and fifth slurries with the first effluent to form the liquid medium.

12. The system of claim 11, further comprising means for rinsing the separated coal particulates separated from the fourth slurry of material adhering thereto with liquid medium; and, means for collecting the effluent consisting of liquid medium used to rinse the coal particulates and material rinsed from the coal particulates as a third effluent.

13. The system of claim 12, further comprising means for mixing the collected second effluent from the fourth slurry with the third effluent.

14. The system of claim 11, further comprising means for rinsing the separated refuse material separated from the fifth slurry of smaller refuse material adhering thereto with liquid medium; and means for collecting the effluent consisting of liquid medium used to rinse the refuse and material rinsed from the refuse as a fifth effluent.

15. The system of claim 14, further comprising means for mixing the fourth collected effluent from the fifth slurry with the fifth effluent.

16. The system of claim 11 further comprising:

means for rinsing the separated coal particulates separated from the fourth slurry of material adhering thereto with liquid medium;

means for collecting the effluent consisting of liquid medium used to rinse the coal particulates and material rinsed from the coal particulates as a third effluent;

means for rinsing the separated refuse material separated from the fifth slurry of smaller refuse material adhering thereto with liquid medium;

means for collecting the effluent consisting of liquid medium used to rinse the refuse and material rinsed from the refuse material as a fifth effluent and mixing the fifth effluent with the fourth effluent;

means for adding portions of the second, third, fourth and fifth effluents together;

means for separating a portion of the mix of second, third, fourth and fifth effluents into an effluent fraction having a lesser specific gravity than the mix of second, third, fourth and fifth effluents, and an effluent fraction having a greater specific gravity than the mix of second, third, fourth and fifth effluents;

means for selectively mixing the effluent fraction of lesser specific gravity with the mix of fourth and fifth effluents to decrease the specific gravity thereof to a predetermined value; and means for selectively mixing the effluent fraction of greater specific gravity with the mix of fourth and fifth effluents to increase the specific gravity thereof to a predetermined value.

* * * * *